US005689615A

United States Patent [19]

Benyassine et al.

[11] Patent Number: 5,689,615

[45] Date of Patent: Nov. 18, 1997

[54] USAGE OF VOICE ACTIVITY DETECTION FOR EFFICIENT CODING OF SPEECH

[75] Inventors: Adil Benyassine, Costa Mesa; Huan-Yu Su, San Clemente, both of Calif.

[73] Assignee: Rockwell International Corporation, Newport Beach, Calif.

[21] Appl. No.: 589,132

[22] Filed: Jan. 22, 1996

[51] Int. Cl.[6] ..... G10L 3/02

[52] U.S. Cl. ..... 395/2.28; 395/2.23; 395/2.24; 395/2.42

[58] Field of Search ..... 395/2.21, 2.23, 395/2.24, 2.25, 2.28, 2.35–2.37, 2.42, 2.2; 379/389, 390

[56] References Cited

U.S. PATENT DOCUMENTS 5,278,944 1/1994 Sasaki et al. ..... 395/2.21

5,475,712 12/1995 Sasaki ..... 395/2.28

5,509,102 4/1996 Sasaki ..... 395/2.28

*Primary Examiner*—Kee M. Tung

*Attorney, Agent, or Firm*—William C. Cray; Philip K. Yu

[57] ABSTRACT

A method for efficient coding of non-active voice periods is disclosed for a speech communication system with (a) a speech encoder, (b) a communication channel and (c) a speech decoder. The method intermittently sends some information about the background noise when necessary in order to give a better quality of overall speech when non-active voice frames are detected. The coding efficiency of the non-active voice frames can achieved by coding the energy of the frame and its spectrum with as few as 15 bits. These bits are not automatically transmitted whenever there is a non-active voice detection. Rather, the bits are transmitted only when an appreciable change has been detected with respect to the last time a non-active voice frame was sent. To appreciate the benefits of the present invention, a good overall quality can be achieved at rate as low as 4 kb/s on the average during normal speech conversation.

9 Claims, 5 Drawing Sheets

FIG. 4.
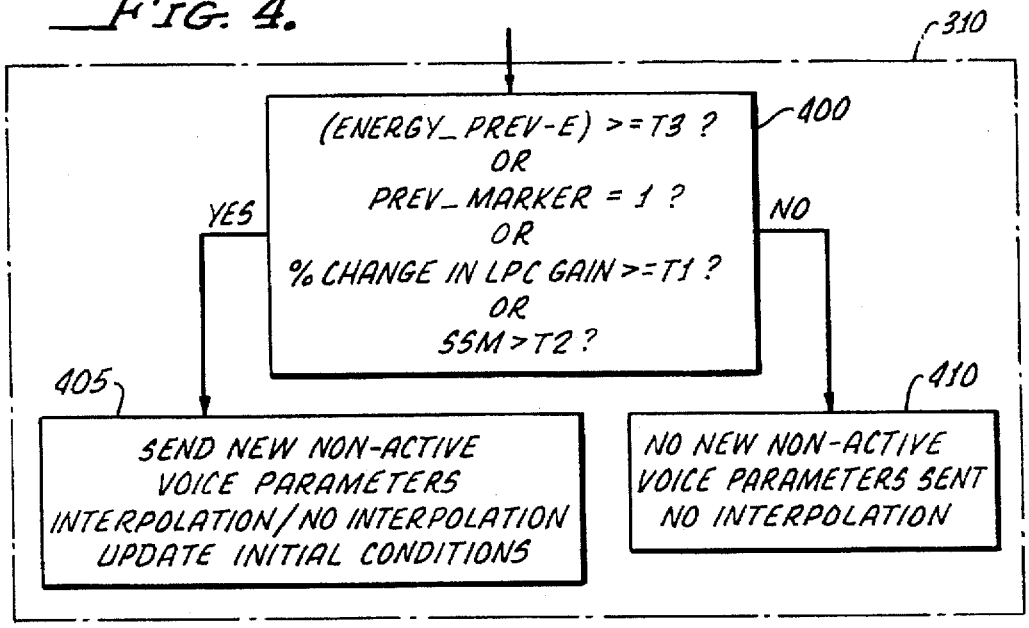
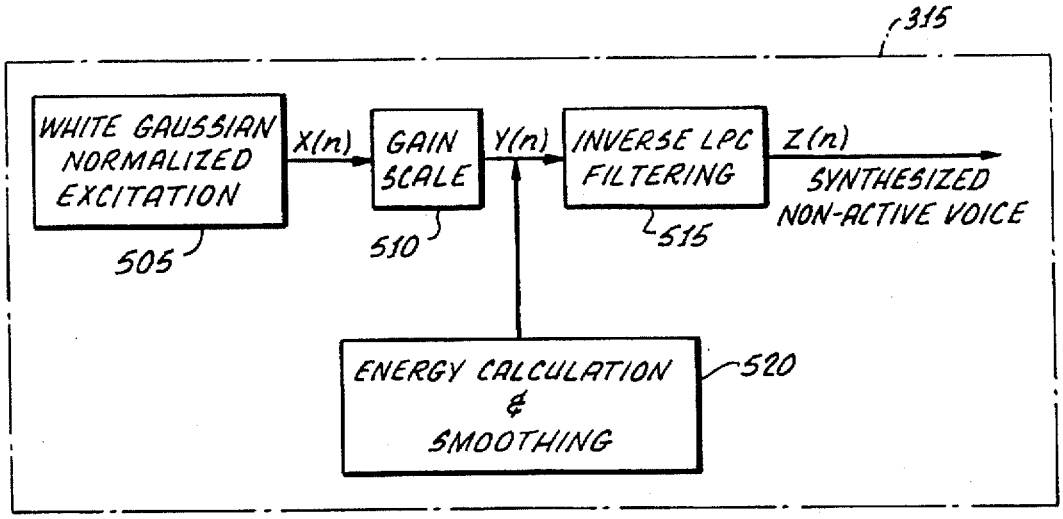
FIG. 5.

USAGE OF VOICE ACTIVITY DETECTION FOR EFFICIENT CODING OF SPEECH

RELATED APPLICATION

The present invention is related to another pending patent application, entitled VOICE ACTIVITY DETECTION, filed on the same date, with Ser. No. 589,509, and also assigned to the present assignee. The disclosure of the Related Application is incorporated herein by reference.

FIELD OF INVENTION

The present invention relates to speech coding in communication systems and more particularly to dual-mode speech coding schemes.

ART BACKGROUND

Modern communication systems rely heavily on digital speech processing in general and digital speech compression in particular. Examples of such communication systems are digital telephone trunks, voice mail, voice annotation, answering machines, digital voice over data links, etc.

As shown in FIG. 1, a speech communication system is typically comprised of a speech encoder 110, a communication channel 150 and a speech decoder 155. On the encoder side 110, there are three functional portions used to reconstruct speech 175: a non-active voice encoder 115, an active voice encoder 120 and a voice activity detection unit 125. On the decoder side 155, a non-active voice decoder 165 and an active voice decoder 170.

It should be understood by those skilled in the art that the term "non-active voice" generally refers to "silence", or "background noise during silence", in a transmission, while the term "active voice" refers to the actual "speech" portion of the transmission.

The speech encoder 110 converts a speech 105 which has been digitized into a bit-stream. The bit-stream is transmitted over the communication channel 150 (which for example can be a storage media), and is converted again into a digitized speech 175 by the decoder 155. The ratio between the number of bits needed for the representation of the digitized speech and the number of bits in the bit-stream is the compression ratio. A compression ratio of 12 to 16 is achievable while keeping a high quality of reconstructed speech.

A considerable portion of a normal speech is comprised of non-active voice periods, up to an average of 60% in a two-way conversation. During these periods of non-active voice, the speech input device, such as a microphone, picks up the environment noise. The noise level and characteristics can vary considerably, from a quite room to a noisy street or a fast moving car. However, most of the noise sources carry less information than the speech and hence a higher compression ratio is achievable during the non-active voice periods.

The above argument leads to the concept of dual-mode speech coding schemes, which are usually also known as "variable-rate coding schemes." The different modes of the input signal (active or non-active voice) are determined by a signal classifier, also known as a voice activity detector ("VAD") 125, which can operate external to or within the speech encoder 110. A different coding scheme is employed for the non-active voice signal through the non-active voice encoder 115, using fewer bits and resulting in an overall higher average compression ratio. The VAD 125 output is binary, and is commonly called "voicing decision" 140. The voicing decision is used to switch between the dual-mode of bit streams, whether it is the non-active voice bit stream 130 or the active voice bit stream 135.

SUMMARY OF THE PRESENT INVENTION

Traditional speech coders and decoders use comfort noise to simulate the background noise in the non-active voice frames. If the background noise is not stationary as it is in many situations, the comfort noise does not provide the naturalness of the original background noise. Therefore it will be desirable to intermittently send some information about the background noise when necessary in order to give a better quality when non-active voice frames are detected. The coding efficiency of the non-active voice frames can achieved by coding the energy of the frame and its spectrum with as few as 15 bits. These bits are not automatically transmitted whenever there is a non-active voice detection. Rather, the bits are transmitted only when an appreciable change has been detected with respect to the last time a non-active voice frame was sent. To appreciate the benefits of the present invention, a good quality can be achieved at rate as low as 4 kb/s on the average during normal speech conversation. This quality generally cannot be achieved by simple comfort noise insertion during non-active voice periods, unless it is operated at the full rate of 8 kb/s.

In a speech communication system with (a) a speech encoder for receiving and encoding incoming speech signals to generate bit streams for transmission to a speech decoder, (b) a communication channel for transmission and (c) a speech decoder for receiving the bit streams from the speech encoder to decode the bit stream, a method is disclosed for efficient encoding of non-active voice periods in according to the present invention. The method comprises the steps of: a) extracting predetermined sets of parameters from the incoming speech signals for each frame, b) making a frame voicing decision of the incoming signal for each frame according to a first set of the predetermined sets of parameters, c) if the frame voicing decision indicates active voice, the incoming speech signal is encoded by an active voice encoder to generate an active voice bit stream, which is continuously concatenated and transmitted over the channel, d) if the frame voicing decision indicates non-active voice, the incoming speech signal being encoded by a non-active voice encoder is used to generate a non-active voice bit stream. The non-active bit stream is comprised of at least one packet with each packet being 2-byte wide and each packet has a plurality of indices into a plurality of tables representative of non-active voice parameters, e) if the received bit stream is that of an active voice frame, the active voice decoder is invoked to generate the reconstructed speech signal, f) if the frame voicing decision indicates non-active voice, the transmission of the non-active voice bit stream is done only if a predetermined comparison criteria is met, g) if the frame voicing decision indicates non-active voice, an non-active voice decoder is invoked to generate the reconstructed speech signal, h) updating the non-active voice decoder when the non-active voice bit stream is received by the speech decoder, otherwise using a non-active voice information previously received.

BRIEF DESCRIPTION OF THE DRAWINGS

Additional objects, features and advantages of the present invention will become apparent to those skilled in the art from the following description, wherein:

FIG. 4 illustrates INPU decision-making as in FIG. 3, 310.

FIG. 5 illustrates the process of synthesizing a non-active voice frame as in FIG. 3, 315.

DETAILED DESCRIPTION OF THE DRAWINGS

Figure 1:
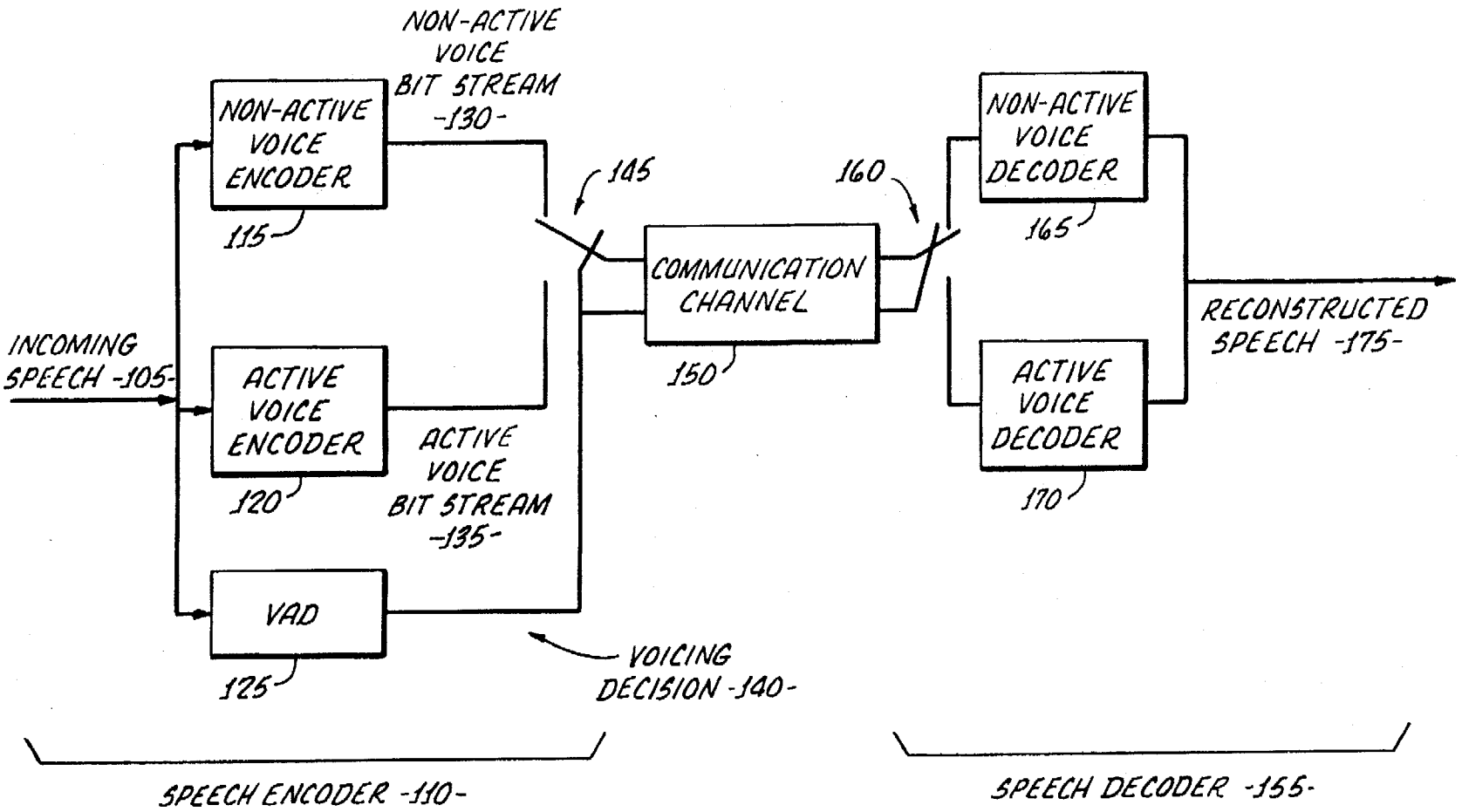
FIG. 1. (PRIOR ART)
FIG. 1 illustrates a typical speech communication system with a VAD.

A method of using VAD for efficient coding of speech is disclosed. In the following description, the present invention is described in terms of functional block diagrams and process flow charts, which are the ordinary means for those skilled in the art of speech coding to communicate among themselves. The present invention is not limited to any specific programming languages, since those skilled in the art can readily determine the most suitable way of implementing the teaching of the present invention.

A. General Description

In accordance with the present invention, the VAD (FIG. 1, 125) and Intermittent Non-active Voice Period Update ("INPU") (FIG. 2, 220) modules are designed to operate with CELP ("Code Excited Linear Prediction") speech coders and in particular with the proposed CS-ACELP 8 kbps speech coder ("G.729"). For listening comfort, the INPU algorithm provides a continuous and smooth information about the non-active voice periods, while keeping a low average bit rate. During an active-voice frame, the speech encoder 110 uses the G.729 voice encoder 120 and the correspondent bit stream is consecutively sent to the speech decoder 155. Note that the G.729 specification refers to the proposed speech coding specifications before the International Telecommunication Union (ITU).

For each non-active voice frame, the INPU module (220) decides if a set of non-active voice update parameters ought to be sent to the speech decoder 155, by measuring changes in the non-active voice signal. Absolute and adaptive thresholds on the frame energy and the spectral distortion measure are used to obtain the update decision. If an update is needed, the non-active voice encoder 115 sends the information needed to generate a signal which is perceptually similar to the original non active-voice signal. This information may comprise an energy level and a description of the spectral envelope. If no update is needed, the non-active voice signal is generated by the non-active decoder according to the last received energy and spectral shape information of a non-active voice frame.

Figure 2:
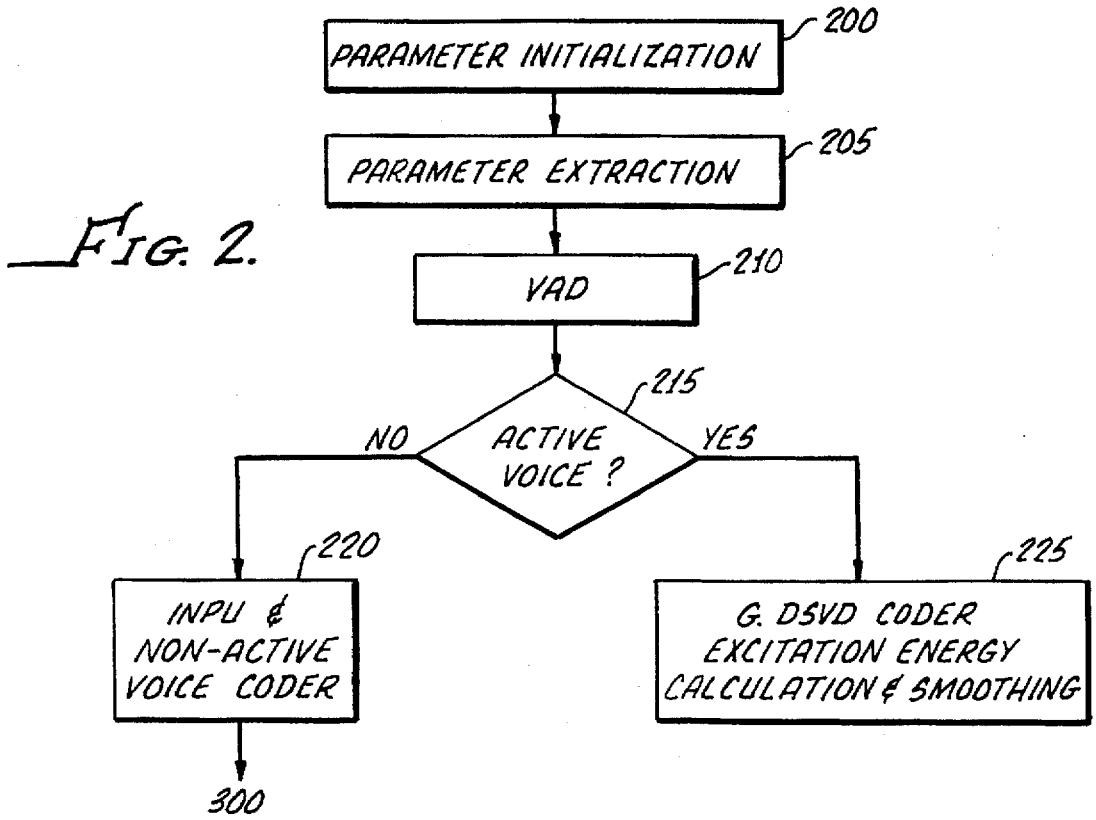
FIG. 2 illustrates the process for non-active voice detection.

A general flowchart of the combined VAD/INPU process of the present invention is depicted in FIG. 2. In the first stage (200), speech parameters are initialized as will be further described below. Then, parameters pertaining to the VAD and INPU are extracted from the incoming signal in block (205). Afterwards, voicing activity detection is made by the VAD module (210; FIG. 1, 135) to generate a voicing decision (FIG. 1, 140) which switches between an active voice encoder/decoder (FIG. 1, 120, 170) and a non-active encoder/decoder (FIG. 1, 115, 165). The binary voicing decision may be set to either a "1" (TRUE) for active voice or a "0" (FALSE) for non-active.

Figure 3:
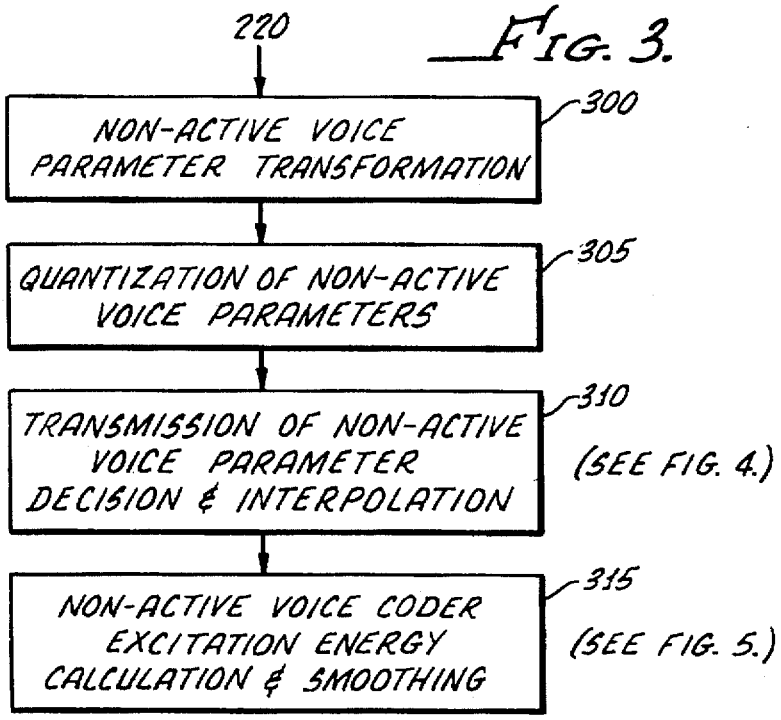
FIG. 3 illustrates the VAD/INPU process when non-active voice is detected by the VAD.

If non-active voice is detected (215) by the VAD, the parameters relevant to the INPU and non-active voice encoder are transformed for quantization and transmission purposes, as will be illustrated in FIG. 3.

B. Parameter Initialization (200)

As will be appreciated by those skilled in the art, adequate initialization is required for proper operation. It is done only once just before the first frame of the input signal is processed. The initialization process is summarized below:

Set the following speech coding variables as:

prev_marker=1, Previous VAD decision.

pprev_marker=1, Previous prev_marker.

RG_LPC=0, Running average of the excitation energy.

GLPC_P=0, Previous non-active excitation energy.

$lar_prev_i$=0, i=1 . . . 10, Latest transmitted log area ratio ("LARs").

energy_prev=−130, Latest transmitted non-active frame energy.

count_marker=0, Number of consecutive active voice frames.

frm_count=0, Number of processed frames of input signal. lpc_gain_prev=0.00001, LPC gain computed from latest transmitted non-active voice parameters.

C. Parameter Extraction & Quantization (205, 305)

In the parameter extraction block (205), the linear prediction (LP) analysis which is performed on every input signal frame provides the frame energy R(0) and the reflection coefficients $\{k_i\}$, i=1,10., as currently implemented with the LPC. First these parameters will be used in particular for the coding and decoding of the non-active periods of the input speech signal. They are transformed respectively to the [dB] domain as $E=10\log_{10}(R(0))$ and to the LAR domain as $$LAR_i = \log\left(\frac{1-k_i}{1+k_i}\right).$$

These transformed parameters (305) are then quantized in the following way. The energy E is currently coded using a five-bit nonuniform scalar quantizer. The LARs are currently quantized, on the other hand, by using a two-stage vector quantization ("VQ") with 5 bits each. However, those skilled in the art can readily code the spectral envelope information in a different domain and/or in a different way. Also, information other than E or LAR can be used for coding non-active voice periods. The quantization of the energy E encompasses a search of a 32 entry table. The closest entry to the energy E in the mean square sense is chosen and sent over the channel. On the other hand, the quantization of the LAR vector entails the determination of the best two indices, each from a different vector table, as it is done in a two stage vector quantization. Therefore, these three indices make up the representative information about the non-active frame.

D. Transmission of Non-active voice Parameter Decision and Interpolation (310)

From the quantized non-active voice parameters namely E and LARs, a quantity named the LPC Gain is computed. The lpc_gain is defined as:

$$lpc_gain = 10^{\frac{E}{20}} \sqrt{\prod_{i=1}^{10} (1-k_i^2)} \ .$$

where $\{k_i\}$ are the reflection coefficients obtained from the quantized LARs and E is the quantized frame energy. A spectral stationary measure is also computed which is defined as the mean square difference between the LARs of the current frame and the LARs of the latest transmitted non-active frame (lar_prev) as $$SSM = \sum_{i=1}^{10} (LAR_i - lar_prev_i)^2$$

FIG. 4 further depicts the flowchart for the INPU decision making as in FIG. 3, 310. A check (400) is made if either the previous VAD decision was "1" (i.e. the previous frame was active voice), or if the difference between the last transmitted non-active voice energy and the current non-active voice energy exceeds a threshold $T_3$, or if the percentage of change in the LPC gain exceeds a threhold $T_1$, or if the SSM exceeds a threshold $T_2$, in order to activate parameter update (405). Note that the threshold can be modified according to the particular system and environment where the present invention is practiced.

In activating parameter update (405), the interpolation and update of initial conditions are performed as follows. A linear interpolation between E and energy_prev is done to compute sub-frame energies $\{E_i\}$, where i=1, 2, as listed below. (Note that for the proposed G.729 specification, "i" represents the 2 sub-frames comprising a frame. However, there may be other specifications with different number of sub-frames within each frame.)

$$E_1 = energy_prev + \frac{1}{2}\ (E - energy_prev)$$

$$E_2 = E$$

The LARs are also interpolated across frame boundaries as:

$$LAR_1^i = lar_prev^i + \frac{1}{2}\ (LAR^i - lar_prev^i)$$

$$LAR_2^i = LAR^i$$

It should be noted that if module 405 is invoked due to the fact that the previous VAD decision is "1", the interpolation is not performed.

E. Non-active Encoder/Decoder, Excitation Energy Calculations & Smoothing (315)

The CELP algorithm for coding speech signals falls into the category of analysis by synthesis speech coders. Therefore, a replica of the decoder is actually embedded in the encoder. Each non-active voice frame is divided into 2 sub-frames. Then, each sub-frame is synthesized at the decoder to form a replica of the original frame. The synthesis of a sub-frame entails the determination of an excitation vector, a gain factor and a filter. In the following, we describe how we determine these three entities. The information which is currently used to code a non-active voice frame comprises the frame energy E and the LARs. These quantities are interpolated as described above and used to compute the sub-frame LPC gains according to:

$$G_LPC_i = 10^{\frac{E_i}{20}} \sqrt{\prod_{j=1}^{10} (1-(k_i^j)^2} \ ,$$

where $i = 1, 2$ and $\{k_i^j\}$ is the $j^{th}$ reflection coefficient of the i-th sub-frame obtained from the interpolated LARs.

Reference is now to FIG. 5, where the block 315 is further illustrated. In order to synthesize a non-active voice sub-frame, a 40-dimensional (as currently used) white Gaussian random vector is generated (505). This vector is normalized to have a unit norm. This normalized random vector x(n) is scaled with a gain factor (510). The obtained vector y(n) is passed through an inverse LPC filter (515). The output z(n) of the filter is thus the synthesized non-active voice sub-frame.

Since the non-active encoder runs alternatively with the active voice encoder depending on the VAD decision, it is necessary to provide smooth energy transition between the switching. For this purpose, a running average (RG_LPC) of the excitation energy is computed both during non-active and active voice periods. The way RG_LPC is updated during non-active voice periods will be discussed in this section. First, G_LPCP is defined to be the value of RG_LPC that was computed during the second sub-frame of speech just before the current non-active voice frame. Thus, it can be written:

G_LPCP=RG_LPC, if (prev_marker=1 and this is the first subframe).

G_LPCP will be used in the scaling factor of x(n).

Figure 6:
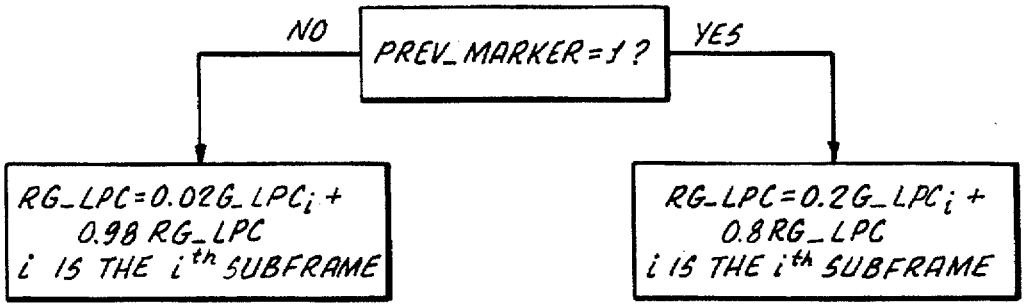
FIG. 6 illustrates the process of updating the Running Average.

The running average RG_LPC is updated before scaling as depicted in the following flowchart of FIG. 6.

Figure 7:
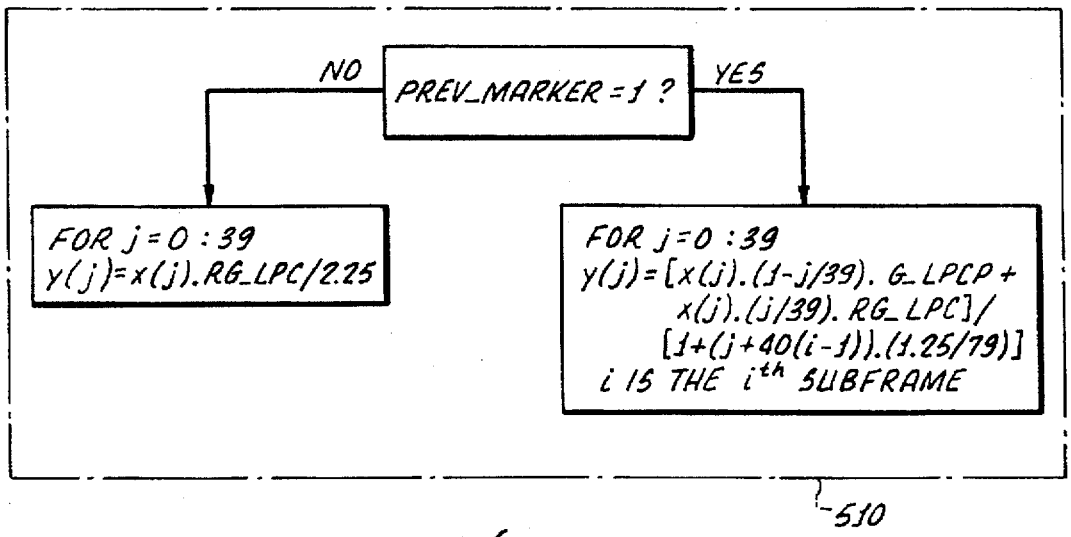
FIG. 7 illustrates the process of gain scaling of excitation as in FIG. 5, 510.

The gain scaling of the excitation x(n), output of block 505, is done as illustrated in FIG. 7 in order to obtain y(n), output of block 510. It should be emphasized that the gain scaling of the excitation of a non-active voice sub-frame entails an additional attenuation factor as FIG. 7 shows. In fact, a constant attenuation factor $$\alpha = \frac{1}{2.25}$$

is used to multiply x(n) if the previous frame is not an active voice frame. Otherwise, a linear attenuation factor $\alpha_j$ of the form:

$$\alpha_j = \frac{1}{1+(j+40(i-1))\beta} \ ,$$

is used, where $$\beta = \frac{1.25}{79} \ ,$$

j is the $j^{th}$ sample of the sub-frame, and i is the $i^{th}$ sub-frame.

In block 520, the energy of the scaled excitation y(n) is calculated. It is denoted by Ext_R_Energy and computed as $$\text{Ext_R_Energy} = \sqrt{\sum_{n=0}^{39} y^2(n)}$$

A running average of the energy of y(n) is computed as: RextRP_Energy=0.1RextRP_Energy+0.9Ext_R_Energy, noting that the weighting coefficients may be modified according to the system and environment.

It should also be noted that the initializing of RextRP_Energy is done only during active voice coder operation. However, it is updated during both non-active and active coder operations.

F. G.729 Active Voice Encoder/Decoder Excitation Energy Calculation & Smoothing

Figure 8:
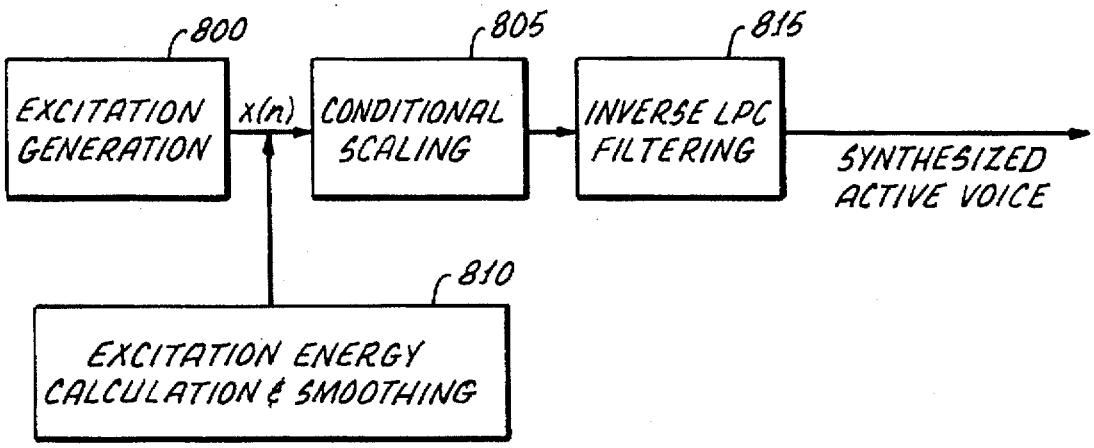
FIG. 8 illustrates the process of synthesizing active voice frame.

The active voice encoder/decoder may operate according to the proposed G.729 specifications. Although the operation of the voice encoder/decoder will not be described here in detail, it is worth mentioning that during active voice frames, an excitation is derived to drive an inverse LPC falter in order to synthesize a replica of the active voice frame. A block diagram of the synthesis process is shown in FIG. 8.

The energy of the excitation x(n) denoted by ExtRP_Energy is computed every sub-frame as:

$$\text{ExtRP_Energy} = \sqrt{\sum_{n=0}^{39} x^2(n)}$$

This energy is used to update a running average of the excitation energy RextRP_Energy as described below.

Figure 9:
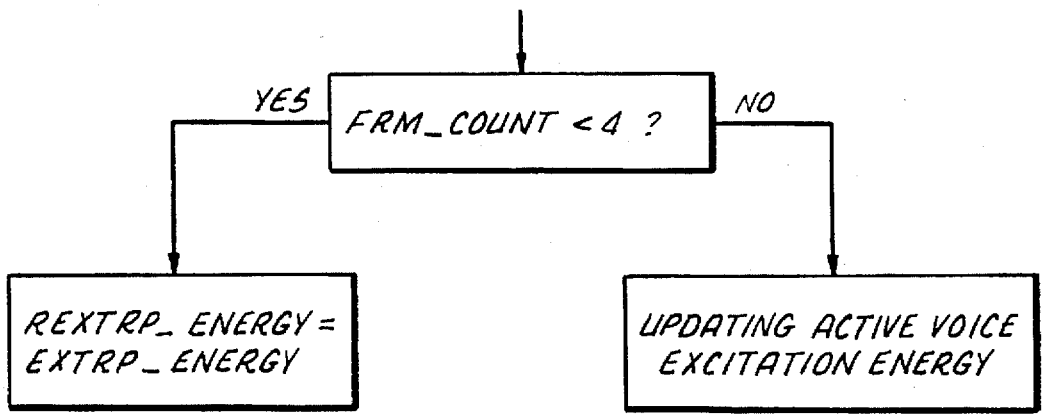
FIG. 9 illustrates the process of updating active voice excitation energy.

First a counter (count_marker) of the number of consecutive active voice frames is used to decide on how the update of RextRP_Energy is done. FIG. 9 depicts a flowchart of this process. The process flow for updating the active voice excitation energy can be expressed as follows:

IF (count_marker=1)

RextRP_Energy=0.95 RextRP_Energy+0.05 ExtRP_Energy

ELSE IF (count_marker=2)

RextRP_Energy=0.85 RextRP_Energy+0.15 ExtRP_Energy

ELSE IF (count_marker=3)

RextRP_Energy=0.65 RextRP_Energy+0.35 ExtRP_Energy

ELSE

RextRP_Energy=0.6 RextRP_Energy+0.4 ExtRP_Energy.

Note that the weighting coefficients can be modified as desired.

The excitation. x(n) is normalized to have unit norm and scaled by RextRP_Energy if count_marker≦3, otherwise, it is kept as derived in block 800. Special care is taken in smoothing transitions between active and non-active voice segments. In order to achieve that, RG_LPC is also constantly updated during active voice frames as $$RG_LPC=0.9\text{ExtRP_Energy}+0.1RG_LPC.$$

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. In a speech communication system comprising: (a) a speech encoder for receiving and encoding an incoming speech signal to generate a bit stream for transmission to a speech decoder; (b) a communication channel for transmission; and (c) a speech decoder for receiving the bit stream from the speech encoder to decode the bit stream to generate a reconstructed speech signal, said incoming speech signal comprising periods of active voice and non-active voice, a method for efficient encoding of non-active voice, comprising the steps of:

a) extracting predetermined sets of parameters from said incoming speech signal for each frame, said parameters comprising spectral content and energy;

b) making a frame voicing decision of the incoming speech signal for each frame according to a first set of the predetermined sets of parameters;

c) if the frame voicing decision indicates active voice, the incoming speech signal being encoded by an active voice encoder to generate an active voice bit stream, continuously concatenating and transmitting the active voice bit stream over the channel;

d) if receiving said active voice bit stream by said speech decoder, invoking an active voice decoder to generate the reconstructed speech signal;

e) if the frame voicing decision indicates non-active voice, the incoming speech signal being encoded by a non-active voice encoder to generate a non-active voice bit stream, said non-active bit stream comprising at least one packet with each packet being 2-byte wide, each packet comprising a plurality of indices into a plurality of tables representative of non-active voice parameters;

f) if the frame voicing decision indicates non-active voice, transmitting the non-active voice bit stream only if a predetermined comparison criteria is met;

g) if the frame voicing decision indicates non-active voice, invoking an non-active voice decoder to generate the reconstructed speech signal;

b) updating the non-active voice decoder when the non-active voice bit stream is received by the speech decoder, otherwise using a non-active voice information previously received.

2. A method according to claim 1, wherein in Step (e) said packet within said non-active bit stream comprises 3 indices with 2 of the 3 being used to represent said spectral content and 1 of the 3 being used to represent said energy from said parameters.

3. A method according to claim 1, wherein one of said predetermined sets of parameters for each frame comprises: energy, LPC gain, and spectral stationarity measure ("SSM"); and wherein said predetermined comparison criteria is satisfied if at least one of the following conditions is met:

a) if energy difference between a last transmitted non-active voice frame to a current frame is greater than or equal to a first threshold;

b) if current frame is a first frame after an active voice frame;

c) if percentage of change in LPC gain between a last transmitted non-active voice frame to a current frame is greater than or equal to a second threshold;

d) if SSM is greater than a third threshold.

4. A method according to claim 2, wherein one of said predetermined sets of parameters for each frame comprises: energy, LPC gain, and spectral stationarity measure ("SSM"); and wherein said predetermined comparison criteria is satisfied if at least one of the following conditions is met:

a) if energy difference between a last transmitted non-active voice frame to a current frame is greater than or equal to a first threshold;

b) if current frame is a first frame after an active voice frame;

c) if percentage of change in LPC gain between a last transmitted non-active voice frame to a current frame is greater than or equal to a second threshold;

d) if SSM is greater than a third threshold.

5. A method according to claim 1, to smooth transitions between active voice and non-active voice frames, the method further comprising the steps of:

a) computing a running average of excitation energy of said incoming speech signal during both active and non-active voice frames;

b) extracting an excitation vector from a local whim Gaussian noise generator available at both said non-active voice encoder and non-active voice decoder;

c) gain-scaling said excitation vector using said running average;

d) attenuating said excitation vector using predetermined factor;

e) generating an inverse LPC filter by using the first predetermined set of speech parameters corresponding to said frame of non-active voice;

f) driving said inverse LPC filter using the gain-scaled excitation vector for said non-active voice decoder to replicate the original non-active voice period.

6. A method according to claim 2, to smooth transitions between active voice and non-active voice frames, the method further comprising the steps of:

a) computing a running average of excitation energy of said incoming speech signal during both active and non-active voice frames;

b) extracting an excitation vector from a local whim Gaussian noise generator available at both said non-active voice encoder and non-active voice decoder;

c) gain-scaling said excitation vector using said running average;

d) attenuating said excitation vector using predetermined factor;

e) generating an inverse LPC filter by using the first predetermined set of speech parameters corresponding to said frame of non-active voice;

f) driving said inverse LPC filter using the gain-scaled excitation vector for said non-active voice decoder to replicate the original non-active voice period.

7. In a speech communication system comprising: (a) a speech encoder for receiving and encoding an incoming speech signal to generate a bit stream for transmission to a speech decoder; (b) a communication channel for transmission; and (c) a speech decoder for receiving the bit stream from the speech encoder to decode the bit stream to generate a reconstructed speech signal, said incoming speech signal comprising periods of active voice and non-active voice, an apparatus coupled to said speech encoder for efficient encoding of non-active voice, said apparatus comprising:

a) extraction means for extracting predetermined sets of parameters from said incoming speech signal for each frame, said parameters comprising spectral content and energy;

b) VAD means for making a frame voicing decision of the incoming speech signal for each frame according to a first set of the predetermined sets of parameters;

c) active voice encoder means for encoding said incoming speech signal, if the frame voicing decision indicates active voice, to generate an active voice bit stream, for continuously concatenating and transmitting the active voice bit stream over the channel;

d) active voice decoder means for generating the reconstructed speech signal, if receiving said active voice bit stream by said speech decoder;

e) non-active voice encoder means for encoding the incoming speech signal, if the frame voicing decision indicates non-active voice, to generate a non-active voice bit stream, said non-active bit stream comprising at least one packet with each packet being 2-byte wide, each packet comprising a plurality of indices into a plurality of tables representative of non-active voice parameters, said non-active voice transmitting the non-active voice bit stream only if a predetermined comparison criteria is met;

f) non-active voice decoder means for generating the reconstructed speech signal, if the frame voicing decision indicates non-active voice;

g) update means for updating the non-active voice decoder when the non-active voice bit stream is received by the speech decoder.

8. An apparatus according to claim 7, wherein said packet within said non-active bit stream comprises 3 indices with 2 of the 3 being used to represent said spectral content and 1 of the 3 being used to represent said energy from said parameters.

9. An apparatus according to claim 7, wherein one of said predetermined sets of parameters for each frame comprises: energy, LPC gain, and spectral stationarity measure ("SSM"); and wherein said predetermined comparison criteria is satisfied if at least one of the following conditions is met:

a) if energy difference between a last transmitted non-active voice frame to a current frame is greater than or equal to a first threshold;

b) if current frame is a first frame after an active voice frame;

c) if percentage of change in LPC gain between a last transmitted non-active voice frame to a current frame is greater than or equal to a second threshold;

d) if SSM is greater than a third threshold.

* * * * *